US005305506A

United States Patent [19]

Forman

[11] Patent Number: 5,305,506

[45] Date of Patent: Apr. 26, 1994

[54] FORMATION OF AN ELEMENT FOR AN ARTICLE OF JEWELLERY

[75] Inventor: Mark Forman, Johannesburg, South Africa

[73] Assignee: Sid Forman (Proprietary) Limited, South Africa

[21] Appl. No.: 971,397

[22] Filed: Nov. 4, 1992

[30] Foreign Application Priority Data

Nov. 8, 1991 [ZA] South Africa ..... 91/8857

[51] Int. Cl.[5] ..... B23P 5/00; A44C 17/02

[52] U.S. Cl. ..... 29/10; 29/160.6; 409/131; 409/198; 409/304; 409/345; 63/15

[58] Field of Search ..... 29/10, 160.6; 409/131, 409/132, 198, 221, 222, 268, 304, 345, 346; 63/15, 15.8, 26

[56] References Cited

U.S. PATENT DOCUMENTS

| | | | |
|---|---|---|---|
| 1,303,940 | 5/1919 | Mooney | 409/198 |
| 2,189,984 | 2/1940 | Hart | 409/268 |
| 2,590,171 | 3/1952 | Green | 409/198 |
| 3,260,158 | 7/1966 | Chiffolot et al. | 409/132 |
| 3,680,439 | 8/1972 | Lancaster et al. . | |
| 3,695,129 | 10/1972 | Vrijma | 409/304 |
| 4,193,722 | 3/1980 | Bishop | 409/268 |
| 4,720,220 | 1/1988 | Bloch et al. | 409/47 |
| 4,761,865 | 8/1988 | Magnien et al. . | |
| 5,044,177 | 9/1991 | Favre . | |
| 5,056,337 | 10/1991 | Nhaissi . | |

FOREIGN PATENT DOCUMENTS

| | | | |
|---|---|---|---|
| 56319 | 5/1981 | Japan | 409/304 |
| 89217 | 4/1988 | Japan | 409/268 |
| 1415026 | 11/1975 | United Kingdom . | |

*Primary Examiner*—Daniel W. Howell
*Attorney, Agent, or Firm*—Harness, Dickey & Pierce

[57] ABSTRACT

The invention relates to the formation of an element, called an "illusion", for an article of jewelry, including a method for forming an illusion, and a device for forming an illusion. First and second substantially parallel grooves are formed in an operatively upper surface of a workpiece, the workpiece is rotated through a predetermined angle, and additional pairs of first and second parallel grooves are formed in the upper surface of the workpiece in order to leave a desired number of spaced prongs projecting from the remaining portion of the workpiece. Such prongs are used to grip and hold a diamond or other stone in position on the workpiece. Preferably each of the pairs of grooves, which can be arcuate grooves, are formed simultaneously. The preferred forming device includes discrete cutting buts arranged in a spaced parallel relationship, with each cutting bit being elongated and having a pair of opposed, bevelled, longitudinal sides, with the bevelled sides meeting for form a cutting edge.

17 Claims, 2 Drawing Sheets

FORMATION OF AN ELEMENT FOR AN ARTICLE OF JEWELLERY

FIELD OF INVENTION

This invention relates to the formation of an element for use in an article of jewellery. More particularly, the invention relates to a method of, and apparatus for, forming an element for use in an article of jewellery.

In certain articles of jewellery, an element known in the trade as an "illusion" is mounted in position in the article of jewellery and a gemstone, conventionally a diamond, is held in the element. In other words, the element is used for mounting the diamond, which is normally a relatively small diamond, in the article of jewellery and the element creates the impression or illusion that the diamond is larger than it is. This impression arises from the size and configuration of the element and from the fact that the element reflects light which enhances light reflected by the diamond.

Hereinafter, in this specification, the term "illusion" is used to describe an element of the type referred to above.

It will be appreciated that such illusions are usually extremely small. Normally the illusion is circular in plan view and has an outer diameter of about 3 mm. A diamond of approximately 1 mm to 1.5 mm in outer diameter in plan view is held captive in a central opening in the illusion, the central opening also having a diameter of about 1 mm. The diamond is held in position in the opening by means of claws. It will be appreciated that, bearing in mind the dimensions of the illusion, the formation of these claws, which have a maximum width of fractions of a millimeter, involves extreme precision. Also, because of the small size of the illusion, it is difficult to form, particularly an illusion which is "lively" in the sense that it reflects light well to enhance the light reflected by the polished diamond.

Accordingly, it is an object of the invention to provide a method of, an apparatus for, forming claws in an illusion and also to provide an illusion which is "lively".

SUMMARY OF THE INVENTION

Accordingly, a first aspect of the invention provides a method of forming an illusion which includes the steps of (a) forming a first groove across an operatively upper surface of a workpiece;

(b) forming at least one further groove across said upper surface, the, or each, further groove being substantially parallel to the first groove;

(c) rotating the workpiece through a predetermined angle; and (d) repeating steps (a) to (c) until sufficient material has been removed from the upper surface of the workpiece to leave a desired number of spaced prongs projecting from a remaining portion of the workpiece.

It will be appreciated that, once the diamond has been mounted in position, the prongs (known as grains) are bent over to grip and hold the diamond in position. In other words, the grains form the claws of the illusion.

In a preferred form of the invention, two such grooves are formed in spaced relationship across the upper surface of the workpiece and, most preferably, the method includes performing steps (a) and (b) simultaneously.

The method may then include forming the first groove so that it intersects a centre of the workpiece and forming the second groove spaced from the centre of the workpiece.

Still further, the method may include forming arcuate grooves in the upper surface of the workpiece. Preferably, the method includes forming the grooves such that their radii of curvature are about three to seven times greater than a major width dimension of the workpiece.

In the case of a circular workpiece, the major width dimension thereof may be the diameter of the workpiece. In the case of a polygonal workpiece, the major width dimension may be that across opposed corners of the workpiece. In other words, for example, in the case of a square workpiece the major width dimension may be the diagonal measurement of the square.

As indicated above, the illusion formed from the workpiece normally has a diameter of approximately 3 mm. Then, the radii of curvature of the arcuate grooves may be in the range of about 10 to 20 mm, more preferably in the range of about 12 to 18 mm and, optimally, about 16 mm.

In a preferred form of the invention, the method includes cutting the grooves in the upper surface of the workpiece. Those skilled in the art will, however, appreciate that the grooves could be formed by other methods, for example, by grinding, burning or the like.

According to a second aspect of the invention, there is provided a device for forming an illusion, the device including a carrier; and a groove forming arrangement carried by the carrier, the groove forming arrangement comprising a plurality of groove forming means arranged in spaced relationship on the carrier to form a plurality of spaced, parallel grooves in a workpiece.

The groove forming arrangement may comprise a plurality of discrete cutting bits, each of which defines one of the groove forming means. In a preferred form of the invention, the device includes two such cutting bits for forming two spaced, parallel grooves in the workpiece.

Each cutting bit may be elongate and may have a pair of opposed, bevelled, longitudinal sides, the bevelled sides meeting to form a cutting edge.

One of the cutting bits, when viewed end-on, may be symmetrical about its cutting edge with the other cutting bit, when viewed end-on, being asymmetrical about its cutting edge.

The cutting bits may be arranged on the carrier such that, in use, the symmetrical cutting bit intersects a centre of the workpiece and the asymmetrical cutting bit is spaced from the centre of the workpiece.

Further, the asymmetrical cutting bit may be arranged on the carrier with a narrower side of the asymmetrical cutting bit being closer to the symmetrical cutting bit than a wider side of the asymmetrical cutting bit.

In the case of both cutting bits, an included angle between the sides of each cutting bit may be an obtuse angle. Preferably, the included angle between the sides is between about 120° to 170°, more preferably is in the range 140° to 160° and, optimally, is about 150°.

A leading end of each cutting bit may also be bevelled to achieve the required cutting and polishing action.

Further, each cutting bit may taper inwardly from its leading end to a trailing end thereof. In the case of the symmetrical cutting bit, both sides of the cutting bit may taper. In the case of the asymmetrical cutting bit, only its narrower side may taper.

In a preferred form of the invention, each cutting bit is in the form of a diamond.

The invention extends also to an illusion made in accordance with the method as described above.

Still further, the invention extends to an illusion made using the device as described above.

The invention is now described by way of example with reference to the accompanying diagrammatic drawings.

DETAILED DESCRIPTION OF THE DRAWINGS

Figure 1:
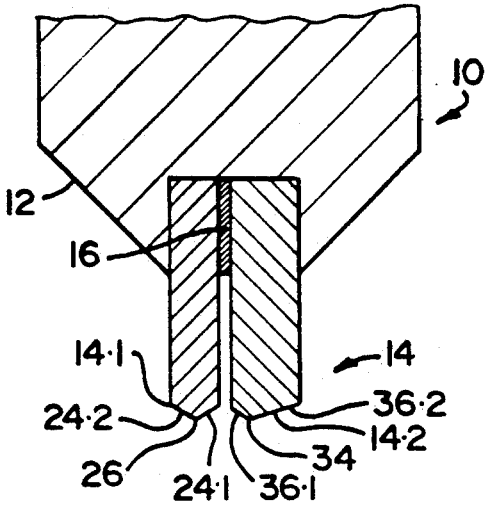
FIG. 1 shows a sectional end view, taken along line I—I in FIG. 2, of a device, in accordance with the invention, for forming an illusion.
Figure 2:
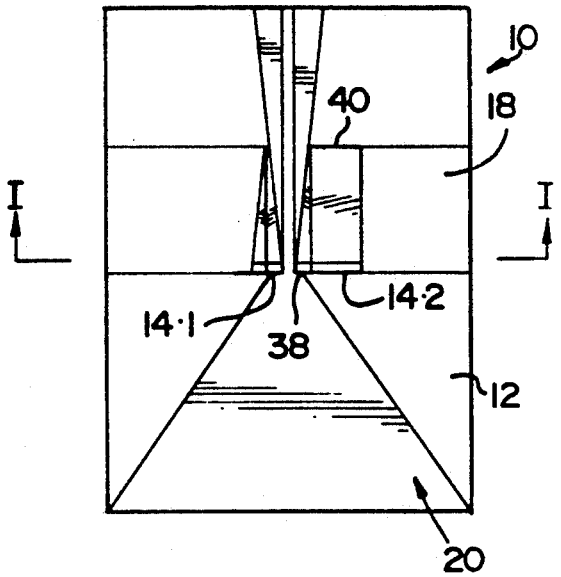
FIG. 2 shows a bottom view of the device.

Referring firstly to FIGS. 1 and 2 of the drawings, a device, in accordance with the invention, for forming an illusion is illustrated and is designated generally by the reference numeral 10.

The device 10 comprises a carrier 12 in which is mounted a plurality of cutting bits 14. More specifically, two such cutting bits 14.1 and 14.2 are mounted in the carrier 12. The cutting bits 14.1 and 14.2 are separated by a spacer 16.

Each cutting bit 14.1 is of a wear resistant material and, more particularly, is a diamond.

As indicated more clearly in FIG. 2 of the drawings, the cutting bits 14.1 and 14.2 are mounted via an insert 18 in the carrier 12. The insert 18 is of brass and the remainder 20 of the carrier is of steel.

Referring now to FIGS. 3 to 6 of the drawings, the cutting bit 14.1 is illustrated in greater detail.

The bit 14.1 comprises an elongate body 22. The body 22 has a pair of opposed, bevelled, longitudinal sides 24.1 and 24.2. The sides 24.1 and 24.2 meet to form a cutting edge 26 extending longitudinally along the bottom of the body 22.

Figure 5:
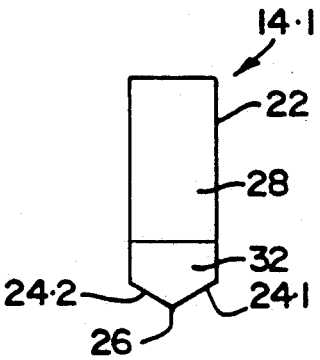
FIG. 5 shows an end view of the cutting bit.
Figure 6:
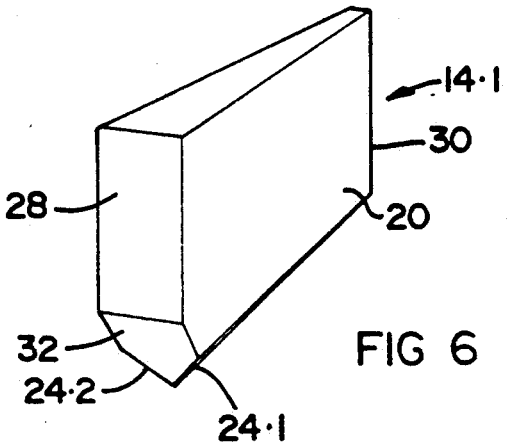
FIG. 6 shows a three dimensional view of the cutting bit.

As illustrated more clearly in FIG. 5 of the drawings, an included angle between the sides 24.1 and 24.2 is an obtuse angle of approximately 150°.

The cutting bit 14.1 tapers inwardly from its leading end 28 to a trailing end 30 thereof. A bottom 32 of the leading end 28 is also bevelled to achieve the required cutting and polishing action on the workpiece.

Figure 3:
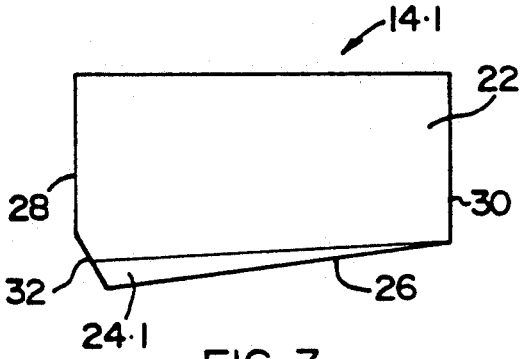
FIG. 3 shows a side view of a cutting bit of the device.
Figure 4:
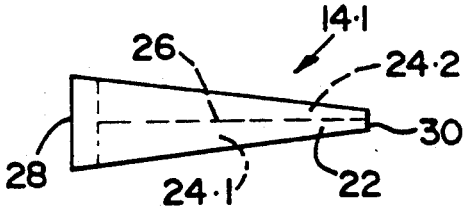
FIG. 4 shows a bottom view of the cutting bit.

Further, it is to be noted from FIG. 3 of the drawings that the side 24.1 and 24.2 taper in width towards the trailing end 30 of the cutting bit 14.1. This ensures that sharp edged grooves are cut in the workpiece. Burring of the groove walls by contact of the cutting bit 14.1 with the workpiece behind the bevelled part 32 of the leading end 28 with the workpiece is inhibited by the tapering shape of the cutting bit 14.1.

It is to be noted from FIGS. 1 and 2 of the drawings that the bit 14.1 is symmetrical about its edge 26 while the bit 14.2 is asymmetrical about its corresponding edge 34 (FIG. 1). The arrangement of the bits 14.1 and 14.2 in the carrier 12 is such that a narrower side 26.1 of the asymmetrical cutting bit 14.2 is closer to the cutting bit 14.1 than a wider side 36.2 of the asymmetrical cutting bit 14.2.

Further, in the case of the cutting bit 14.2, only the narrower side 36.1 of the asymmetrical cutting bit 14.2 tapers from its leading end 38 (FIG. 2) to its trailing end 40. The purpose of the taper 14.2 is the same as that of the taper of the bit 14.1. However, as the cutting bit 14.2, in use, cuts an outer groove in the workpiece, as will be described below, it is unnecessary for the wider side 36.2 of the cutting bit 14.2 to taper.

Figure 9:
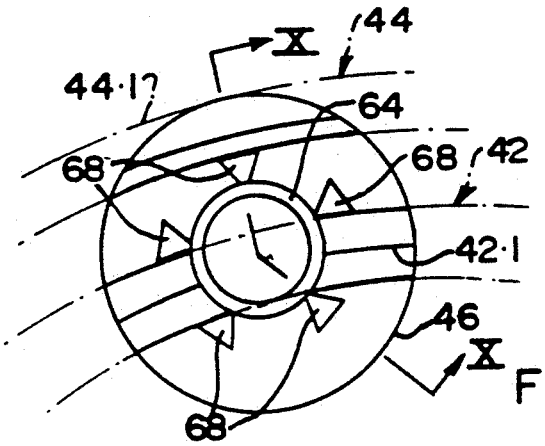
FIG. 9 is a schematic plan view of an illusion indicating the formation of the grooves therein.

The device 10, in accordance with the invention, is used for cutting a pair of spaced, parallel grooves 42 and 44 in a workpiece 46 (FIG. 9). To enable these grooves 42 and 44 to be cut in the workpiece 46, the device 10 is mounted in a machine tool in the form of a milling machine 48, as illustrated more clearly in FIG. 7 of the drawings. The milling machine 48 comprises a milling head 50 in which the device 10 is removably mounted. The milling head 50 is rotatable about a rotational axis 52 as indicated by arrow 54. The milling head 50 is rotatably driven about the rotation axis 52 via an appropriate drive means (not shown). The milling machine 48 further includes a work surface 56 on which a support 58 is mounted. In use, the workpiece 46 to be machined is held captive on the support 58. The support 58 is mounted to be rotatable about an axis 60 as indicated by arrow 62.

As described in the introduction to this specification, the device 10, in accordance with the invention, is intended particularly for use in the formation of an illusion. The illusion is formed from the workpiece 46. The washer-like workpiece 46 is annular and has an opening 64 defined therein. A diamond (not shown) is receivable in the opening 64 and is held captive by bent over grains 68 formed in the upper surface 66 of the workpiece 46.

Figure 7:
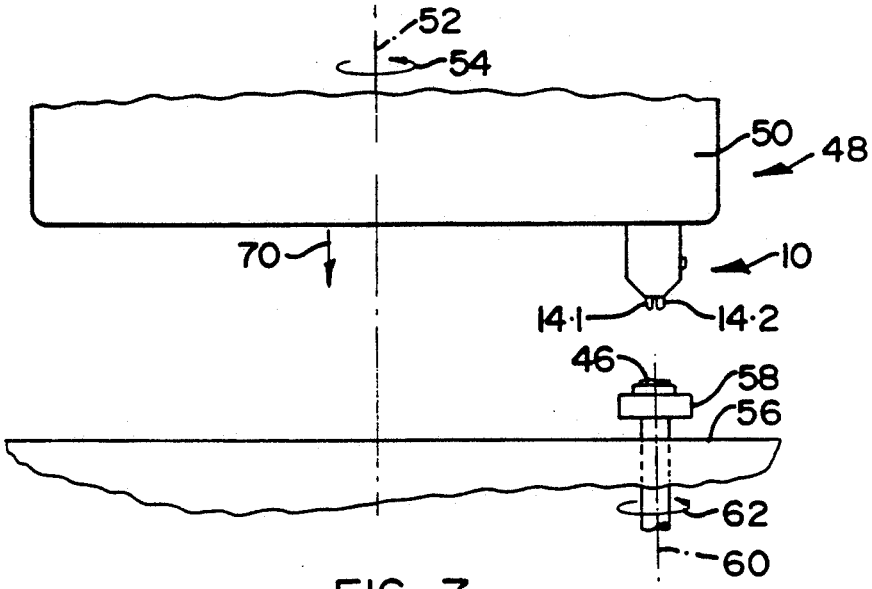
FIG. 7 shows, schematically, an apparatus for use with the method of the invention.
Figure 8:
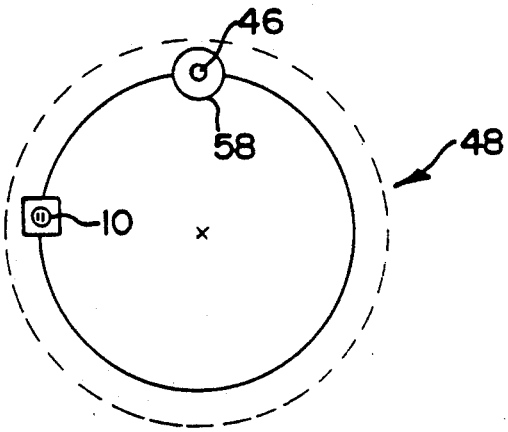
FIG. 8 is a schematic plan view of the apparatus of FIG. 7.

Hence, in use, the washer-like workpiece 46, is mounted on the support 58 of the milling machine 48. The device 10 is secured in position o the milling head 50 of the machine 48. As illustrated in FIGS. 7 and 8 of the drawings, the device 10 is radially spaced with respect to the rotational axis 52 of the milling head 50. Preferably, the device 10 has a radial spacing of about 16 mm as measured from the rotational axis 52 to between the cutting bits 14.1 and 14.2.

The milling head 50 is rotated in the direction of the arrow 54. Further, the milling head 50 is urged towards the work surface 56, in the direction of arrow 70 such that, when the cutting bits 14.1 and 14.2 pass over the workpiece 46, the grooves 42 and 44, of the required depth, are cut in the upper surface 66 of the workpiece 46 by the cutting heads 14.1 and 14.2, respectively.

The cutting bit 14.1 passes through the centre of the workpiece 46 although a centre-line 42.1 of the groove 42 so formed is off-set with the respect to the centre of the workpiece 46 in this particular example, where five grains 68 are formed. The cutting bit 14.2, in contrast, passes over an outer portion of the workpiece 46 so that an outer edge 44.1 of the groove 44 so formed is substantially tangential to an outer periphery of the workpiece 46.

Once the grooves 42 and 44 have been formed in the upper surface 66 of the workpiece 46, the milling head 50 is raised in a direction opposite to that indicated by arrow 70. The rotatable support 58 is then rotated about its rotational axis 60 in the direction of the arrow 62. The amount by which the rotatable support 58 is rotated will be dependent on the number of grains 68 to be formed in the workpiece 46. Hence, in the example illustrated, where five such grains 68 are formed, the rotatable support 58 is rotated through an angle of 72°. Thereafter, the milling head 50 is again urged towards the work surface 56 in the direction of the arrow 70 such that a second pair of grooves (not shown) are formed in the upper surface 66 of the workpiece 46, said second pair of grooves being spaced from the first pair of grooves 42, 44 by an angle of 72°.

To form the five grains 68, the operation is repeated a further three times.

Figure 10:
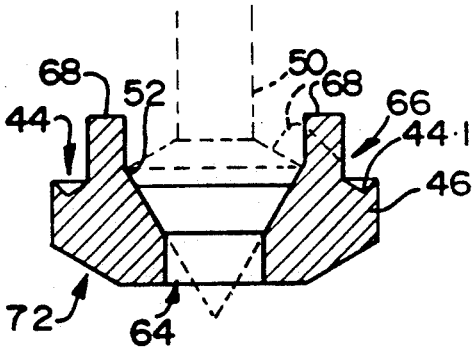
FIG. 10 shows a sectional side view of the illusion taken along line X—X in FIG. 9.

To finish the illusion, two further steps are carried out on the workpiece 46 after the formation of the grains 68. First of all, an operatively lower surface of the workpiece 46 is chamfered, as at 72 to facilitate seating of the illusion, so formed, in an article of jewellery (not shown). Secondly, an upper side of the hole 64 is countersunk using a burr 50 to form a frusto conical seat 52 in which the diamond is received. Once the diamond has been placed in the countersunk hole 64, the grains 68 are bent over as indicated in dotted line; in FIG. 10 of the drawings.

The Applicant has found that the method of forming the illusion from the workpiece 46, as described above, can be done rapidly and is relatively easy to perform using a computer controlled milling machine 48. Further, the illusion formed from the workpiece 46 is "lively" due to the crossing of the grooves. The amount of "life" can be varied by varying the radial spacing of the device 10 from the rotational axis 52 of the milling head 50 and also by varying the included angle between the sides 24 and 36 of the cutting bits 14.1 and 14.2, respectively. Also, the manner in which light is reflected by the illusion is enhanced by the formation of the asymmetrical groove 44 and the other four outer grooves (not shown) formed by the asymmetrical cutting bit 14.2.

I claim:

1. A method of forming an illusion which includes the steps of (a) forming a first groove across an operatively upper surface of a workpiece;

(b) forming at least one further groove across said upper surface, the, or each, further groove being substantially parallel to the first groove;

(c) rotating the workpiece through a predetermined angle; and (d) repeating steps (a) to (c) until sufficient material has been removed from the upper surface of the workpiece to leave a desired number of spaced prongs projecting from a remaining portion of the workpiece.

2. The method as claimed in claim 1 which includes performing steps (a) and (b) simultaneously.

3. The method as claimed in claim 1 which includes forming the first groove so that it intersects a centre of the workpiece and forming the, or each, further groove spaced from the center of the workpiece.

4. The method as claimed in claim 1 which includes forming arcuate grooves in the upper surface of the workpiece.

5. The method as claimed in claim 4 which includes forming the grooves such that their radii of curvature are about three to seven times greater than a major width dimension of the workpiece.

6. The method as claimed in claim 1 which includes cutting the grooves in said upper surface of the workpiece.

7. A device for forming an illusion, the device including a carrier; and a groove forming arrangement carried by the carrier, the groove forming arrangement comprising a plurality of discrete cutting bits arranged in spaced parallel relationship on the carrier to form a plurality of spaced, substantially parallel grooves in a workpiece, and each cutting bit being elongate and having a pair of opposed, bevelled, longitudinal sides, the bevelled sides meeting to form a cutting edge.

8. The device as claimed in claim 7 which includes two such cutting bits.

9. The device as claimed in claim 7 in which one of the cutting bits, when viewed end-on, is symmetrical about its cutting edge and the other cutting bit, when viewed end-on, as asymmetrical about its cutting edge.

10. The device as claimed in claim 9 in which the cutting bits are arranged on the carrier such that, in use, the symmetrical cutting bit intersects a centre of the workpiece and the asymmetrical cutting bit is spaced from the centre of the workpiece.

11. The device as claimed in claim 9 in which the asymmetrical cutting bit is arranged on the carrier with a narrower side of the asymmetrical cutting bit being closer to the symmetrical cutting bit than a wider side of the asymmetrical cutting bit.

12. The device as claimed in claim 7 in which an included angle between the sides of each cutting bit is an obtuse angle.

13. The device claimed in claim 12 in which the included angle is between about 120° to 170°.

14. The device as claimed in claim 7 in which a leading end of each cutting bit is also bevelled.

15. The device as claimed in claim 14 in which each cutting bit tapers inwardly from its leading end to a trailing end thereof.

16. The device as claimed in claim 7 in which each cutting bit is a diamond.

17. An illusion made in accordance with the method as claimed in claim 1.

* * * * *